US010071411B2

(12) United States Patent
Hirata et al.

(10) Patent No.: US 10,071,411 B2
(45) Date of Patent: Sep. 11, 2018

(54) PRESS DIE

(71) Applicant: TOYOTA BOSHOKU KABUSHIKI KAISHA, Aichi-ken (JP)

(72) Inventors: Kazuyuki Hirata, Toyota (JP); Harutaka Oda, Toyota (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/820,641

(22) Filed: Nov. 22, 2017

(65) Prior Publication Data

US 2018/0154423 A1 Jun. 7, 2018

(30) Foreign Application Priority Data

Dec. 5, 2016 (JP) ..... 2016-235807

(51) Int. Cl.

| | |
|---|---|
| ***B21D 37/02*** | (2006.01) |
| ***B21D 37/10*** | (2006.01) |
| ***B21D 22/02*** | (2006.01) |
| ***B21D 19/12*** | (2006.01) |
| ***B21D 26/039*** | (2011.01) |

(52) U.S. Cl.

CPC ..... *B21D 37/10* (2013.01); *B21D 19/12* (2013.01); *B21D 22/02* (2013.01); *B21D 26/039* (2013.01); *B21D 37/02* (2013.01)

(58) Field of Classification Search

CPC ..... B21D 37/02; B21D 19/12; B21D 26/039; B21D 37/10; B21D 22/02; B21C 3/06

USPC ..... 72/476

See application file for complete search history.

(56) References Cited

U.S. PATENT DOCUMENTS

| | | | | |
|---|---|---|---|---|
| 2,472,515 | A * | 6/1949 | Brinkoeter | B21D 37/02 72/475 |
| 2,783,815 | A * | 3/1957 | Tegarden | B21D 37/10 249/155 |
| 3,436,951 | A * | 4/1969 | Phillips, Jr. | B21C 3/06 72/468 |
| 7,251,973 | B2 * | 8/2007 | Gharib | B21D 26/039 100/231 |
| 7,434,433 | B2 * | 10/2008 | Holmes | B21D 19/12 72/481.3 |
| 9,656,314 | B2 * | 5/2017 | Hirata | B21D 37/02 |

FOREIGN PATENT DOCUMENTS

| | | |
|---|---|---|
| JP | 2014-231073 | 12/2014 |

* cited by examiner

*Primary Examiner* — David B Jones
(74) *Attorney, Agent, or Firm* — Greenblum & Bernstein, P.L.C.

(57) ABSTRACT

A press die having a shaping face includes a holding frame, die members, a reference member, and a pressing bolt. Each of the die members includes a first surface that configures the shaping face. The die members are aligned in the holding frame. The reference member is arranged on an inner side surface of the holding frame to position the die members. The pressing bolt is supported by the holding frame on a side opposite to the reference member. The pressing bolt presses the die members against the reference member.

8 Claims, 5 Drawing Sheets

PRESS DIE

BACKGROUND OF THE INVENTION

The present invention relates to a press die that is used to form, for example, a separator for a fuel cell.

For a typical separator used in a fuel cell, a configuration is known in which passages for hydrogen and oxygen are formed by protrusions and recesses, which are formed in a workpiece plate made of hard material such as titanium.

Japanese Laid-Open Patent Publication No. 2014-231073 discloses a press die apparatus that has a press die for forming one such separator. The press die apparatus includes a lower die and an upper die. The lower die has a shaping face with protrusions and recesses on its upper surface. The upper die is arranged above the lower die in an approachable-separable manner with respect to the lower die. The upper die has, on its lower surface, a shaping face with protrusions and recesses corresponding to the shaping face with protrusions and recesses of the lower die. With a workpiece plate mounted on the shaping face of the lower die, the upper die is moved closer toward the lower die to press the workpiece plate to form protrusions and recesses on the workpiece plate between the shaping faces of the two dies.

In the conventional press die apparatus disclosed in the aforementioned publication, the upper and lower dies are each configured by die members each having a quadrangular prism-like shape. In each of the dies, the die members are received and aligned in a frame arranged on a table.

Wedge units are arranged between each frame and the corresponding die members. Each of the wedge units includes a first wedge member and a second wedge member. The first wedge member is in contact with the die members and is in a floating state. The second wedge member is in contact with the first wedge member at an inclined surface, is also in contact with the frame, and is fixed to the table by means of screws. The inclined surfaces of the two wedge members are pressed against each other to produce a wedge effect by which the die members are pressed by the first wedge member in an aligned state and are thus fixed in the aligned state.

However, in the conventional press die apparatus, after repeating pressing many times, vibration and impact caused by the pressing gradually move each first wedge member, which is in a floating state, toward the workpiece plate against the wedge effect. The first wedge member may thus come into contact with the workpiece plate. This causes adverse influence on the forming accuracy of the workpiece plate.

To prevent this problem, the angles of the inclined surfaces of the two wedge members may be increased. However, this increases the force by which the inclined surfaces of the wedge members are pressed against each other. This correspondingly increases the force component that acts on each frame, which is located on the outer side of the corresponding wedge unit, thus deforming the frame. Also, great force may act on the screw, with which the second wedge member is fixed, in a curving direction or axial direction, thus deforming the screw or displacing the second wedge member together with the screw from a predetermined position. Further, if the first wedge member moves in a state in which the inclined surfaces of the two wedge members are pressed against each other, the inclined surfaces may be damaged. These problems can deteriorate the machining accuracy for the workpiece plate.

SUMMARY OF THE INVENTION

Accordingly, it is an objective of the present invention to provide a press die that is capable of preventing problems in the machining accuracy even after repeating pressing many times.

To achieve the foregoing objective, a press die having a shaping face is provided. The press die includes a holding frame and a plurality of die members, each of which includes a first surface that configures the shaping face. The die members are aligned in the holding frame. The press die further includes a reference member, which is arranged on an inner side surface of the holding frame to position the die members, and a pressing bolt, which is supported by the holding frame on a side opposite to the reference member. The pressing bolt presses the die members against the reference member.

DETAILED DESCRIPTION OF THE PREFERRED EMBODIMENTS

One embodiment will now be described with reference to the drawings.

Figure 1:
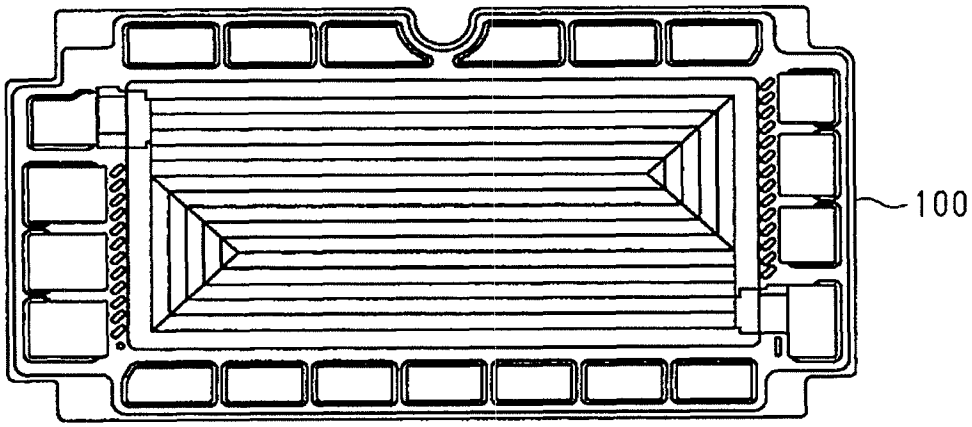
FIG. 1 is a plan view of a separator for a fuel cell.

A press die apparatus 11 is used to form a separator 100 for a fuel cell, which is shown in FIG. 1.

Figure 2:
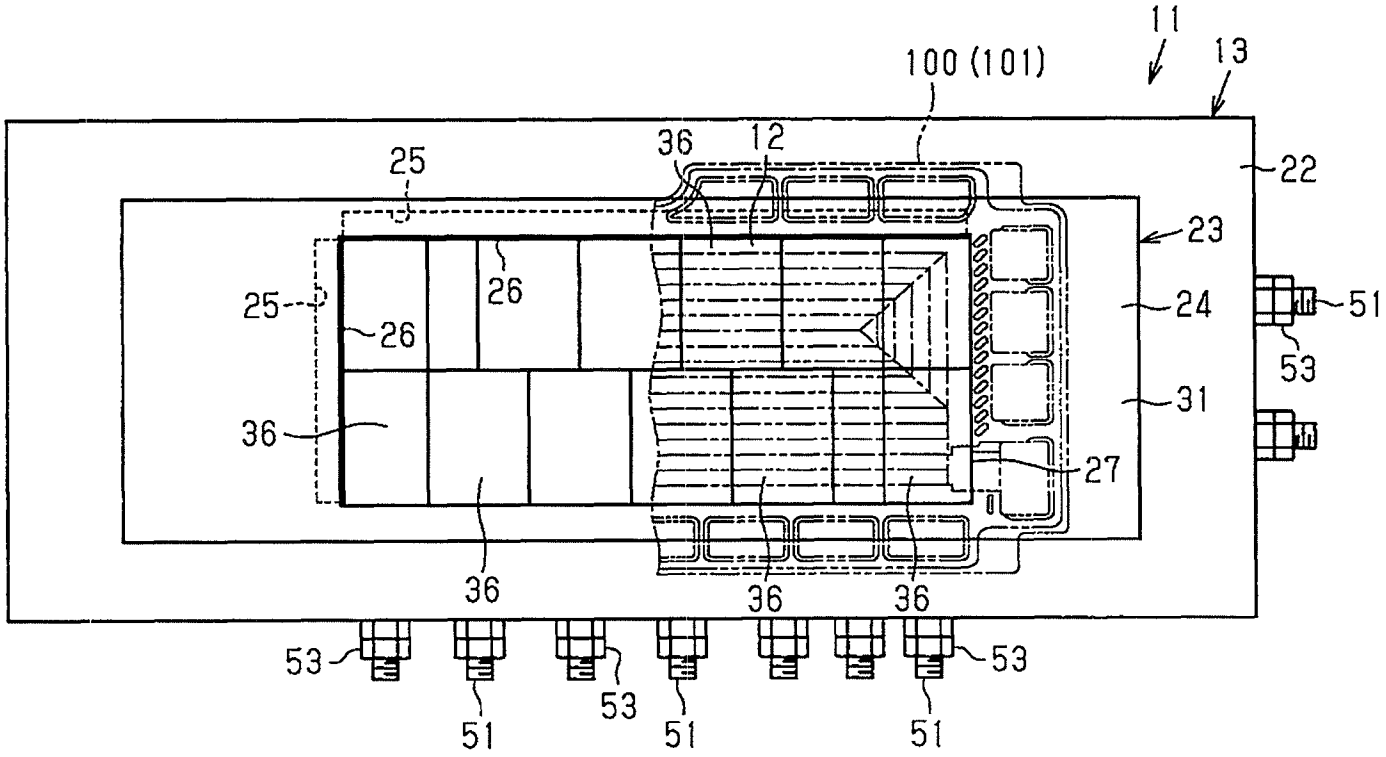
FIG. 2 is a plan view of a press die.
Figure 3:
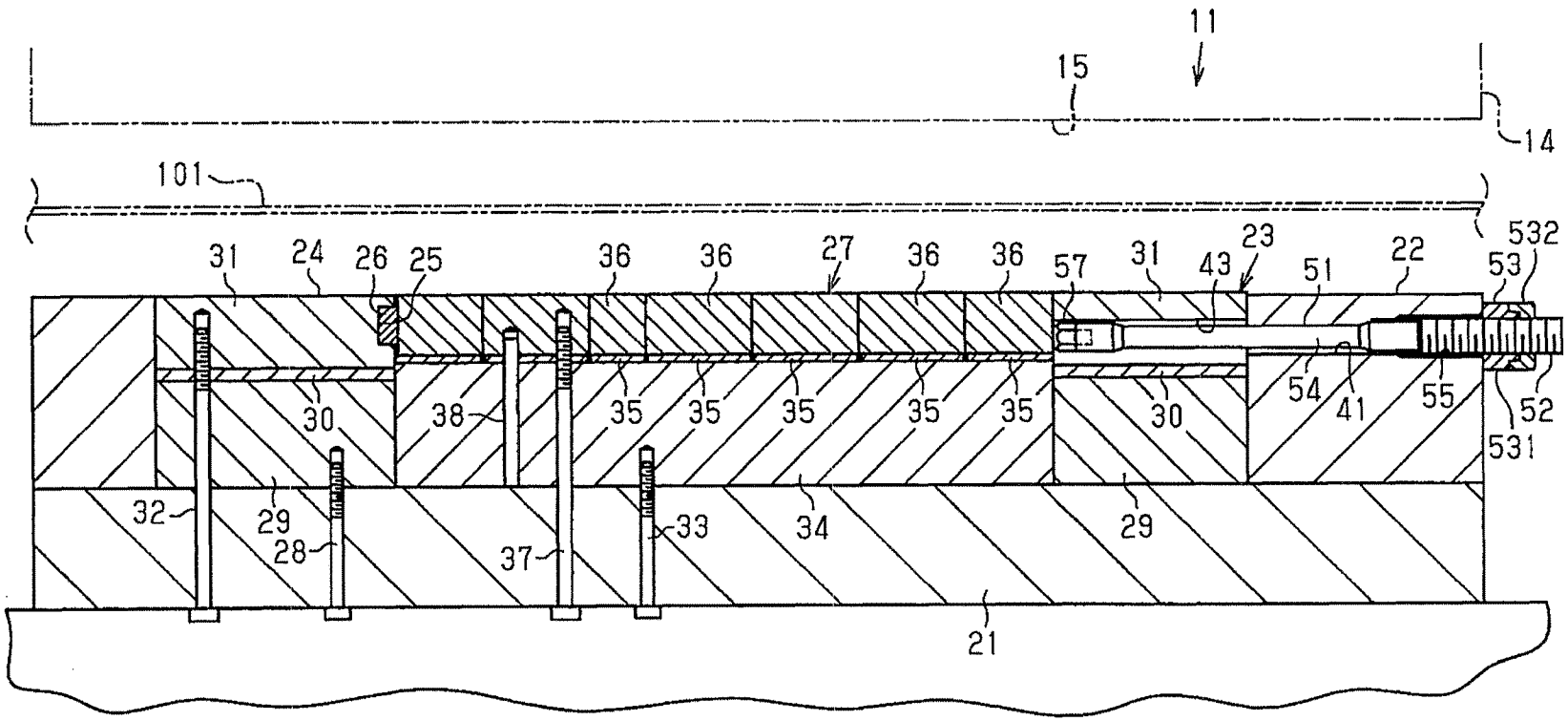
FIG. 3 is a cross-sectional view of the press die.

As shown in FIGS. 2 and 3, the press die apparatus 11 includes a lower die 13 as a press die, which has a shaping face 12 with protrusions and recesses on the upper surface. The protrusions and recesses of the shaping face 12 are not shown in the drawings. An upper die 14 as a press die, which has a shaping face 15 on the lower surface, is arranged above the lower die 13 in an approachable-separable manner with respect to the lower die 13. The lower die 13 and the upper die 14 are opposed to each other. The unevenness of the shaping face 15 of the upper die 14 has protrusions and recesses that correspond to the protrusions and recesses of the shaping face 12 of the lower die 13. With a workpiece plate 101 mounted on the lower die 13, the upper die 14 is moved closer toward the lower die 13 to subject the workpiece plate 101 to pressing between the shaping faces 12, 15 of the two dies 13, 14. As a result, the separator 100, which has protrusions and recesses, is formed.

The protrusions and recesses of the shaping faces 12, 15 correspond to each other. Thus, other than the slight difference in the shapes of the protrusions and recesses, the lower die 13 and the upper die 14 have the same structure. Therefore, the configuration of the lower die 13 will hereafter be described and description of the configuration of the upper die 14 will be omitted.

With reference to FIGS. 2 and 3, the lower die 13 includes a base table 21 and a rectangular outer frame 22, which is arranged on the base table 21. The outer frame 22 is fixed to the base table 21 by means of a non-illustrated bolt. A die unit 23 is accommodated on the inner side of the outer frame 22. The die unit 23 is configured by an outer die 24 having a rectangular frame-like shape, reference plates 26, and an inner die 27. The reference plates 26 are received in recesses 25, which are formed in adjacent two of the inner side surfaces of the outer die 24. The inner die 27 is arranged on the inner side of the outer die 24. In the present embodiment, the outer frame 22 and the outer die 24 configure a holding frame. The outer die 24 configures an inner frame. The reference plates 26 each configure a reference member.

The outer die 24 is configured by a die table 29, which is mounted on the base table 21, and a die member 31, which is arranged on the die table 29 with a shim 30 in between. The die table 29 is fixed to the base table 21 by means of a bolt 28. The die member 31 is fixed to the base table 21 by means of a bolt 32.

The inner die 27 is configured by a single die table 34, which is mounted on the base table 21, and block-shaped die members 36, which are arranged on the die table 34 each with a shim 35 in between in an aligned state. The die table 34 is fixed to the base table 21 by means of a bolt 33. The die members 36 are each fixed to the base table 21 by means of a bolt 37. Each die member 36 and the corresponding shim 35 are positioned temporarily by a positioning pin 38 at the time of assembly.

The shaping face 12 is formed on the upper surfaces of the die members 31, 36. That is, the die members 31, 36 each have a first surface (an upper surface), which configures the shaping face 12 of the lower die 13.

Figure 4:
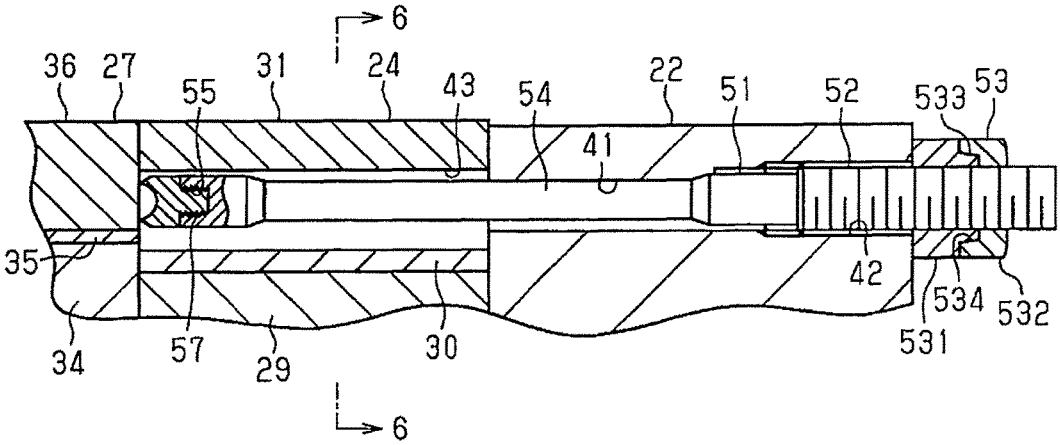
FIG. 4 is a cross-sectional view of a pressing bolt of the press die.
Figure 6:
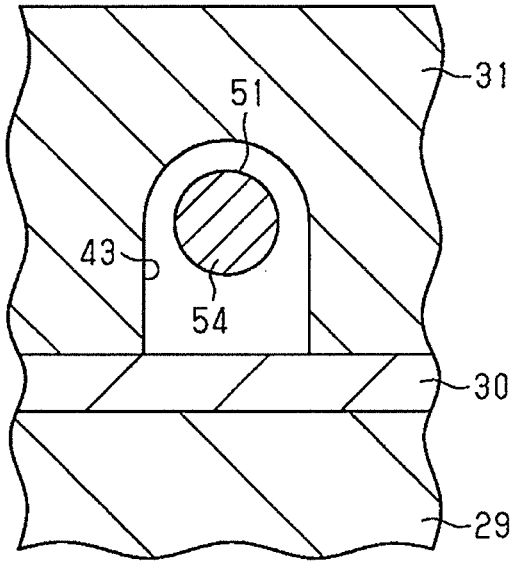
FIG. 6 is a cross-sectional view taken along line 6-6 of FIG. 4.

As illustrated in FIGS. 2 to 4, through-holes 41 are formed in the outer frame 22 at positions corresponding to two of the four inner side surfaces of the outer die 24, which are opposed to the two inner side surfaces in which the reference plates 26 are arranged. Each of the through-holes 41 extends through the part between the inner side surface and the outer side surface of the outer frame 22. An internal thread portion 42 is formed in a section of the inner surface of each through-hole 41 in the vicinity of the outer side surface of the outer frame 22. With reference to FIGS. 4 and 6, insertion recesses 43 as insertion portions, each of which communicates with the corresponding one of the through-holes 41, are formed in the outer die 24. Each of the insertion recesses 43 extends through the part between the inner side surface and the outer side surface of the outer die 24. Each insertion recess 43 is opposed to the side surface of the adjacent one of the die members 36. Each insertion recess 43 extends downward to form an inverted U-shaped cross section and opens in the lower surface of the die member 31.

A pressing bolt 51 is inserted into each of the through-holes 41 and the corresponding one of the insertion recesses 43. A clearance is formed between each of the pressing bolts 51 and the inner surface of the corresponding one of the insertion recesses 43 to permit the pressing bolt 51 to move in a direction perpendicular to the upper surface (the first surface that configures the shaping face 12 of the lower die 13) of the outer die 24. Each pressing bolt 51 has an external thread portion 52 in its basal end section. The external thread portion 52 of the pressing bolt 51 is threaded into the internal thread portion 42 of the outer frame 22. A lock nut 53 is threaded onto each of the external thread portions 52 and is fastened to the corresponding outer side surface of the outer frame 22. Each of the lock nuts 53 is configured by two nut members 531, 532. That is, the lock nut 53 is configured by a double nut. As a result, through the effect of each lock nut 53, the corresponding pressing bolt 51 is locked in a state in which the pressing bolt 51 is locked against rotation. Specifically, in each lock nut 53, one of the nut members 531, 532 has a projection and the other has a corresponding recess such that the nut members 531, 532 are engageable with each other. Also, the lock nut 53 has conically inclined surfaces 533, 534, which are eccentric with respect to each other. By pressing the inclined surfaces 533, 534 against each other, each lock nut 53 applies the pressing force to the external thread portion 52 of the corresponding pressing bolt 51, thus attaining the locking effect of the pressing bolt 51.

Figure 5:
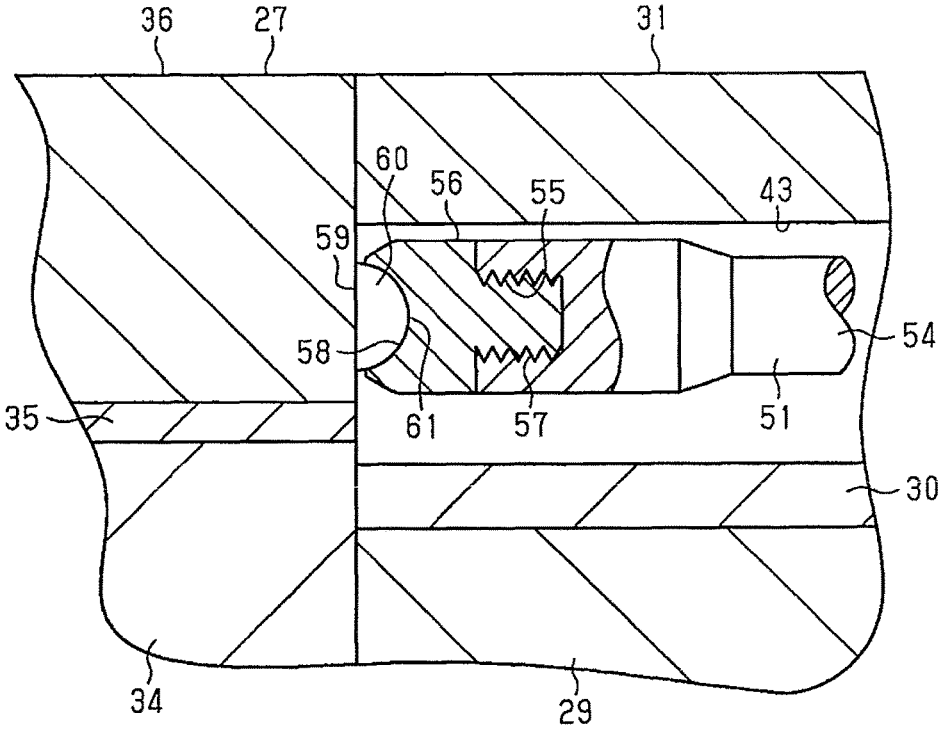
FIG. 5 is a cross-sectional view of a distal end section of the pressing bolt.

As shown in FIGS. 4 and 5, each pressing bolt 51 has a small-diameter portion 54 provided at a position closer to the distal end than the external thread portion 52 is to the distal end. An internal thread portion 55 is formed on the distal end of the pressing bolt 51. An external thread portion 57 of a distal-end member 56, which has a hexagonal shape, is threaded into each of the internal thread portions 55. A support portion 58, which is formed by a concave semi-spherical surface, is formed on the distal end surface of each of the distal-end members 56. A pressing member 60, which has a flat surface 59 on its front surface, is rotationally supported by each of the support portions 58. More specifically, each of the pressing members 60 has a convex semispherical portion 61. Each pressing member 60 is rotationally supported by the corresponding support portion 58 through the semispherical portion 61. The pressing member 60 configures a spherical bearing. By fastening each pressing bolt 51, the flat surface 59 of the corresponding pressing member 60 is caused to press the corresponding one of the die members 36 of the inner die 27 that is adjacent to the pressing member 60. This presses the die member 36 against the corresponding reference plate 26, thus restricting the position of the die member 36.

The operation of the embodiment, which is configured as described above, will hereafter be described.

In the lower die 13, the die members 36 of the inner die 27 are arranged in the outer die 24. The die members 36 are fixed by being pressed against the corresponding reference plates 26 by the corresponding pressing bolts 51 and are positioned by the reference plates 26. This restricts movement of the die members 36, thus arranging the die members 36 in a predetermined aligned state. The maximum movement amount of each die member 36 caused by pressing by the corresponding pressing bolt 51 corresponds to the clearance between the external thread portion of the corresponding bolt 37 and the internal thread portion of the die member 36 and the clearance between the corresponding positioning pin 38 and the inner surface of the hole in which the positioning pin 38 is inserted.

If the fastening force acting on each pressing bolt 51 is excessive, the small-diameter portion 54 of the pressing bolt 51 is distorted in a direction perpendicular to the direction in which stress acts on the pressing bolt 51. In other words, when the excessive fastening force acts on the pressing bolt 51, the axial fastening force that acts on the pressing bolt 51 deforms the small-diameter portion 54 in an expanding manner, thus decreasing the total length of the small-diameter portion 54. The fastening force acting on the pressing bolt 51, which is excessive, is thus attenuated.

Then, in this state, pressing is performed on the workpiece plate 101 between the lower die 13 and the upper die 14 to form the separator 100. Holes for coolant of a fuel cell are arranged in the outer peripheral section of the separator 100. Specifically, the holes are punched out before forming the separator 100.

In the press die apparatus 11, the two dies 13, 14 have no members in a floating state. Also, the die members 36 of the inner die 27 are pressed by the corresponding pressing bolts 51 and the positions of the die members 36 are restricted by the corresponding reference plates 26. As a result, even after repeating pressing many times, the aligned state of the die members 36 is maintained, thus preventing adverse influence on forming of the separator 100.

When the upper surfaces of the outer die 24 and the inner die 27 (the first surfaces that configures the shaping face 12 of the lower die 13) are worn after repeating pressing many times, the upper surfaces are subjected to grinding using a machining device to cut and form a new shaping face 12. Through such grinding and cutting, the height of each die member 31, 36 decreases. Therefore, the shims 30, 35 are each replaced by a shim that has a thickness increased by the amount corresponding to such decrease of the height. This raises the positions at which the die members 31, 36 are installed, thus maintaining the height of the shaping face 12. In this case, in the die member 31 of the outer die 24, the insertion recess 43 extends downward and opens in the lower surface of the die member 31. As a result, even if the position at which the die member 31 is installed is raised by using a thick shim 30, interference between the die member 31 and any one of the pressing bolts 51 does not happen.

The present embodiment achieves the following advantages.

(1) The reference plates 26 are arranged on the inner side surfaces of the outer die 24. The die members 36 of the inner die 27 are in contact with the reference plates 26. The pressing bolts 51, which are threaded into the outer frame 22 on the sides opposite to the reference plates 26, press the die members 36 against the corresponding reference plates 26. Therefore, unlike the die described in Japanese Laid-Open Patent Publication No. 2014-231073, a unit that uses a wedge in a floating state is unnecessary and there is no component that rises and comes into contact with the workpiece plate 101 due to vibration and impact caused by repeating pressing many times. As a result, high machining accuracy is maintained in forming the separator 100, regardless of the number of the times of pressing.

(2) The outer die 24 is arranged on the inner side of the outer frame 22. The reference plates 26 and the die members 36 are arranged on the inner side of the outer die 24. The pressing bolts 51 are threaded into the internal thread portions 55 in the outer frame 22. The die members 36 are thus properly pressed against the reference plates 26 in the outer die 24. This maintains the accurate relationship of the positions of the die members 36 in the aligned state, while also maintaining the accurate relationship between the positions of the die members 36 and the position of the outer die 24. As a result, highly accurate machining of the separator 100 is possible.

(3) If the upper surface (the first surface that configures the shaping face 12 of the lower die 13) of the outer die 24 is worn and re-machined and the height of the outer die 24 decreases, the shim 30 is replaced by a thicker shim to compensate for such decrease of the height of the outer die 24, thus maintaining the height of the upper surface (the first surface) of the outer die 24. In this case, although replacing the shim 30 by a thicker shim raises the position at which the outer die 24 is installed, the fact that the insertion recesses 43 in the outer die 24 extend downward ensures avoidance of interference between each pressing bolt 51 and the inner surface of the corresponding insertion recess 43.

(4) The pressing bolts 51 are fastened to the outer frame 22 by means of the lock nuts 53. As a result, even after repeating pressing many times, loosening of the pressing bolts 51 is avoided. The die members 36 are thus pressed and maintained at predetermined installing positions. This prevents decrease of machining accuracy.

(5) The pressing member 60 is rotationally supported by the distal end of the pressing bolt 51 through the semispherical portion 61. The pressing member 60 presses the die member 36. As a result, even when the side surface of the die member 36 is inclined, the pressing member 60 readily follows such inclination of the side surface of the die member 36. This allows the pressing member 60, or the pressing bolt 51, to properly press the die member 36, thus contributing to highly accurate machining.

(6) The small-diameter portion 54 is arranged between the distal end of each pressing bolt 51 and the external thread portion 52. As a result, if the pressing bolt 51 is excessively fastened or excessive pressure is applied to the pressing bolt 51 from the die member 36 for some reason, the small-diameter portion 54 is deformed to absorb the excessive load that acts on the pressing bolt 51. Damages to the die member 36 and the pressing bolt 51 are thus prevented.

(7) The reference plates 26 are received in the recesses 25 of the outer die 24. This restricts movement of each reference plate 26 in the vertical direction, which is a movement of the reference plate 26 in the pressing direction and the direction opposite to the pressing direction. The positions of the die members 36 are thus restricted to the predetermined positions such that the die members 36 are maintained at the predetermined positions. Also, since a thick reference plate can be used as each reference plate 26, damage to the reference plate 26 is prevented. Further, even if a thick reference plate is used as each reference plate 26, the gap between the outer die 24 and each die member 36 can be reduced. This minimizes separation between the upper surface (the first surface that configures the shaping face 12 of the lower die 13) of the outer die 24 and the upper surface (the first surface that configures the shaping face 12 of the lower die 13) of the die member 36, which is effective in improving machining accuracy.

The above-described embodiment may be modified as follows.

In the above-described embodiment, the reference plates 26 are received in the recesses 25 of the outer die 24. However, instead of the recesses 25 in the outer die 24, recesses may be formed in the corresponding die members 36, and the reference plates 26 may be received in the recesses. Alternatively, the recesses may be formed in both of the outer die 24 and the die members 36, and the reference plates 26 may be received in these recesses.

A reference plate that restricts the position of the outer die 24 may be arranged between the outer frame 22 and the outer die 24.

The present invention may be employed in a die that lacks the outer die 24. That is, the inner die 27 may be arranged in the outer frame 22 without employing the outer die 24. In this case, the upper surface of the outer frame 22 may configure the shaping face 12 of the lower die 13. As a result, this configuration lacks the inner frame, and the outer frame 22 solely configures the holding frame.

The insertion recesses 43 do not necessarily need to open in the lower surface of the outer die 24. That is, an insertion portion may be configured by an elongated insertion hole, which has an oblong cross section. Also in this case, a clearance is formed between the inner surface of the insertion portion, which is configured by the insertion hole, and the corresponding pressing bolt 51 to permit the pressing bolt 51 to move in a direction perpendicular to the upper surface (the first surface that configures the shaping face 12 of the lower die 13) of the outer die 24.

An elastic member made of rubber may be arranged on the flat surface 59 of the pressing member 60 at the distal end of each pressing bolt 51. This allows the pressing member 60 to follow, with improved effectiveness, inclination of the side surface of the corresponding die member 36. Further, excessive pressure between the pressing member 60 and the die member 36 and impact caused by pressing are attenuated.

The invention claimed is:

1. A press die having a shaping face, the press die comprising:

a holding frame;

a plurality of die members, each of which includes a first surface that configures the shaping face, the die members being aligned in the holding frame, a reference member, which is arranged on an inner side surface of the holding frame to position the die members; and a pressing bolt, which is supported by the holding frame on a side opposite to the reference member, wherein the pressing bolt presses the die members against the reference member, the holding frame is configured by an outer frame and an inner frame, which is arranged inside the outer frame and has a first surface that configures the shaping face, the reference member and the die members are arranged on an inner side of the inner frame; and the pressing bolt is supported by the outer frame.

2. The press die according to claim 1, wherein at least one of the inner frame and the die members includes a recess, and the reference member is received in the recess.

3. The press die according to claim 1, wherein the outer frame includes a through-hole that extends through the outer frame between an inner side surface and an outer side surface of the outer frame, an internal thread portion is formed on an inner surface of the through-hole;

the pressing bolt includes an external thread portion formed in a basal end section of the pressing bolt, and the external thread portion of the pressing bolt is threaded into the internal thread portion of the outer frame.

4. A press die having a shaping face, the press die comprising:

a holding frame;

a plurality of die members, each of which includes a first surface that configures the shaping face, the die members being aligned in the holding frame, a reference member, which is arranged on an inner side surface of the holding frame to position the die members; and a pressing bolt, which is supported by the holding frame on a side opposite to the reference member, wherein the pressing bolt presses the die members against the reference member, the holding frame is configured by an outer frame and an inner frame, which is arranged inside the outer frame and has a first surface that configures the shaping face, the reference member and the die members are arranged on an inner side of the inner frame, the pressing bolt is supported by the outer frame, the outer frame includes a through-hole that extends through the outer frame between an inner side surface and an outer side surface of the outer frame, an internal thread portion is formed on an inner surface of the through-hole;

the pressing bolt includes an external thread portion formed in a basal end section of the pressing bolt, the external thread portion of the pressing bolt is threaded into the internal thread portion of the outer frame, the inner frame includes an insertion portion, the pressing bolt is inserted into the insertion portion, and a clearance that permits movement of the pressing bolt in a direction perpendicular to the first surface of the inner frame is provided between the pressing bolt and an inner surface of the insertion portion.

5. A press die having a shaping face, the press die comprising:

a holding frame;

a plurality of die members, each of which includes a first surface that configures the shaping face, the die members being aligned in the holding frame, a reference member, which is arranged on an inner side surface of the holding frame to position the die members; and a pressing bolt, which is supported by the holding frame on a side opposite to the reference member, wherein the pressing bolt presses the die members against the reference member, the holding frame is configured by an outer frame and an inner frame, which is arranged inside the outer frame and has a first surface that configures the shaping face, the reference member and the die members are arranged on an inner side of the inner frame, the pressing bolt is supported by the outer frame, the outer frame includes a through-hole that extends through the outer frame between an inner side surface and an outer side surface of the outer frame, an internal thread portion is formed on an inner surface of the through-hole;

the pressing bolt includes an external thread portion formed in a basal end section of the pressing bolt, the external thread portion of the pressing bolt is threaded into the internal thread portion of the outer frame, and the pressing bolt is fastened to the outer frame by a lock nut.

6. The press die according to claim 3, wherein the pressing bolt includes a small-diameter portion that is arranged closer to a distal end of the pressing bolt than the external thread portion is to the distal end.

7. The press die according to claim 3, wherein the pressing bolt includes a spherical bearing that is arranged at a distal end of the pressing bolt, and the spherical bearing presses the die members.

8. The press die according to claim 1, wherein the inner frame includes a recess that opens in an inner side surface of the inner frame, and the reference member is received in the recess.

* * * * *